United States Patent [19]

Abendroth et al.

[11] Patent Number: 4,583,459

[45] Date of Patent: Apr. 22, 1986

[54] SHEET-FED PRINTING MACHINE WITH MEANS FOR CUTTING SHEETS LONGITUDINALLY

[75] Inventors: Paul Abendroth, Offenbach am Main; Dietrich Dettinger, Heusenstamm; Roland Höll, Weiterstadt; Wolfgang Schales, Muhlheim/Main, all of Fed. Rep. of Germany

[73] Assignee: M.A.N.-Roland Druckmaschinen Aktiengesellschaft, Fed. Rep. of Germany

[21] Appl. No.: 612,042

[22] Filed: May 18, 1984

[30] Foreign Application Priority Data

May 18, 1983 [DE] Fed. Rep. of Germany ..... 3318068

[51] Int. Cl.[4] ..... B41F 13/58

[52] U.S. Cl. ..... 101/217; 101/227; 400/621.1

[58] Field of Search ..... 101/224, 226, 227, 217; 400/621.1; 83/500, 503, 505, 506, 508.2, 433

[56] References Cited

U.S. PATENT DOCUMENTS

| | | | |
|---|---|---|---|
| 1,351,751 | 9/1920 | Hoff | 83/505 X |
| 2,360,653 | 10/1944 | Davidson | 83/506 |
| 3,091,146 | 5/1963 | Bulk | 83/506 X |
| 3,200,685 | 8/1965 | Heilbrunn | 83/505 X |
| 3,543,625 | 12/1970 | Rowland | 83/433 |
| 3,818,827 | 6/1974 | Johne et al. | 101/232 X |

FOREIGN PATENT DOCUMENTS

| | | | |
|---|---|---|---|
| 459377 | 5/1928 | Fed. Rep. of Germany | 83/505 |

*Primary Examiner*—Charles Pearson

*Attorney, Agent, or Firm*—Leydig, Voit & Mayer, Ltd.

[57] ABSTRACT

A cutting assembly for a sheet fed printing machine having a feed drum for supporting individual sheets and feeding them one after another to the impression cylinder for printing by the blanket cylinder, including a knife blade having a cutting edge, a knife blade support, an arm for mounting the support adjacent the feed drum, the arm being pivoted about an axis parallel to the axis of the feed drum for limited rocking movement toward and away from the feed drum, a stop and a clamp for establishing a reference cutting position for the arm, the feed drum having an anvil extending around its periphery cooperating with the edge of the knife blade for cutting of the sheet as the feed drum rotates, way surfaces between the knife blade support and the arm for guiding the knife blade support for movement in the plane perpendicular to the feed drum and along a path of adjustment which bears a shallow angle to a line of tangency to the feed drum, and a manually operated adjusting screw effectively interposed between the arm and the knife blade support for adjusting the knife blade support along its path of adjustment thereby to vary the degree of engagement of the knife blade with respect to the anvil surface.

5 Claims, 11 Drawing Figures

FIG. 1.
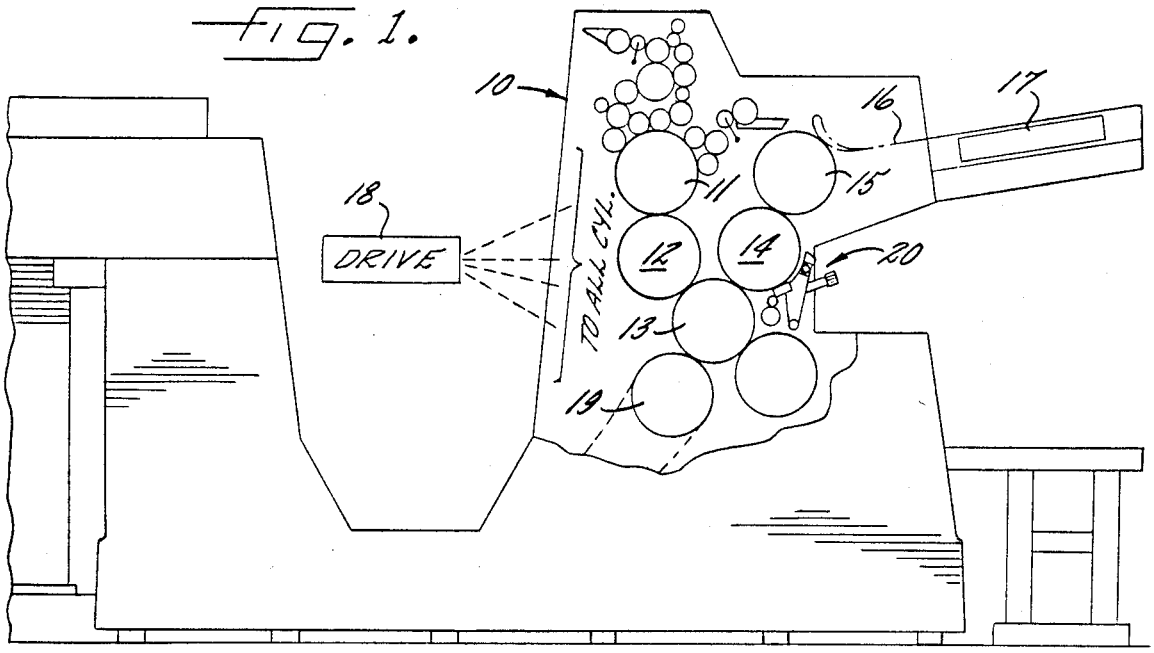
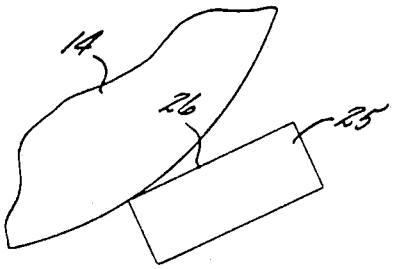
FIG. 3.
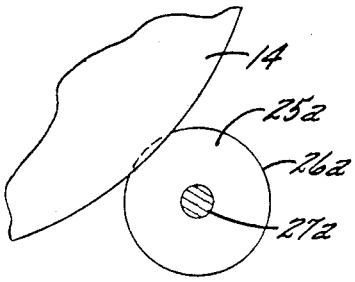
FIG. 4.
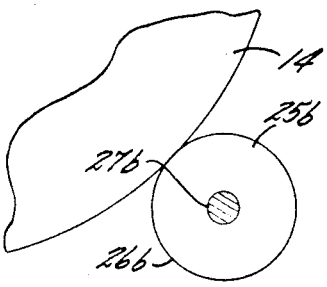
FIG. 5.
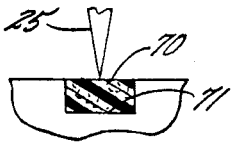
FIG. 3a.
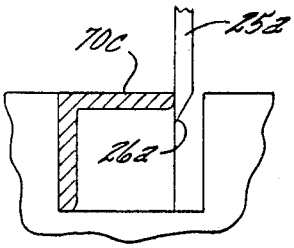
FIG. 4a.
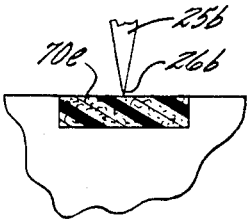
FIG. 5a.
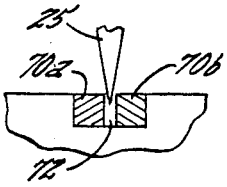
FIG. 3b.
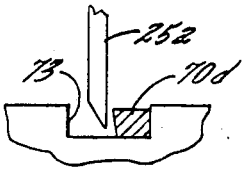
FIG. 4b.
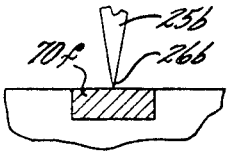
FIG. 5b.

16
14
61
62
60
90
25
26
β
27
70
28
30
31
34
33
51
41
32
50
80
α
α
40
35
42
44
43
44
52
21
20
22

SHEET-FED PRINTING MACHINE WITH MEANS FOR CUTTING SHEETS LONGITUDINALLY

Cutting machines for cutting the sheets in a sheet-fed printing press incident to the printing operation are known in the art as represented, for example, by German Auslegeschrift No. 1216327. Such document discloses a rotating circular bottom knife and a fixed coacting knife having small cutting plates pressed into contact resiliently at the cutting edges on either side of the circular knife. However, prior machines have been relatively elaborate and expensive, difficult to adjust and to operate, and not well adapted to accommodation of sheets of differing type or composition. Moreover there is a tendency, in some cases, to smear the printed product.

Accordingly, it is a general object of the invention to provide a cutting assembly for a sheet-fed printing machine which is simple and economical in construction, easily operated, safe, and readily accessible, even while the press is running.

It is an object of the present invention to provide a cutter for a sheet-fed printing machine which is highly precise, in which the blade may be bodily disengaged or "thrown off", but in which the setting of the blade, after throw-off, and with respect to the sheet support, is instantly reproduced without care or attention on the part of the operator.

It is another object to provide a cutter for a sheet-fed printing machine which accommodates either fixed or rotatable (disk type) knife blades and which is highly versatile, cutting by either slitting or shearing action, or a combination of the two, depending upon the type or composition of the sheet which is being cut. It is a related object to provide a cutting assembly which has universal application to new presses and, by retrofit, to presses already in the field.

It is still another object of the invention to provide a cutter for a sheet-fed printing machine which cuts the sheet incident to, and just prior to, the printing thereof, but which is free of any possibility of smearing or otherwise affecting the quality of the printed product.

It is yet another object to provide a sheet cutter for a sheet-fed printng machine which is capable of cutting a sheet anywhere along its width dimension and which may be readily adapted for the making of multiple cuts.

Other objects and advantages of the invention will become apparent upon reading the attached detailed description and upon reference to the drawings in which:

FIG. 1 is an elevational view of a portion of a printing press showing the location of the cutting assembly therein.

FIG. 3 is an elevational diagram showing use of a fixed blade cooperating with a feed drum.

Figure 2:
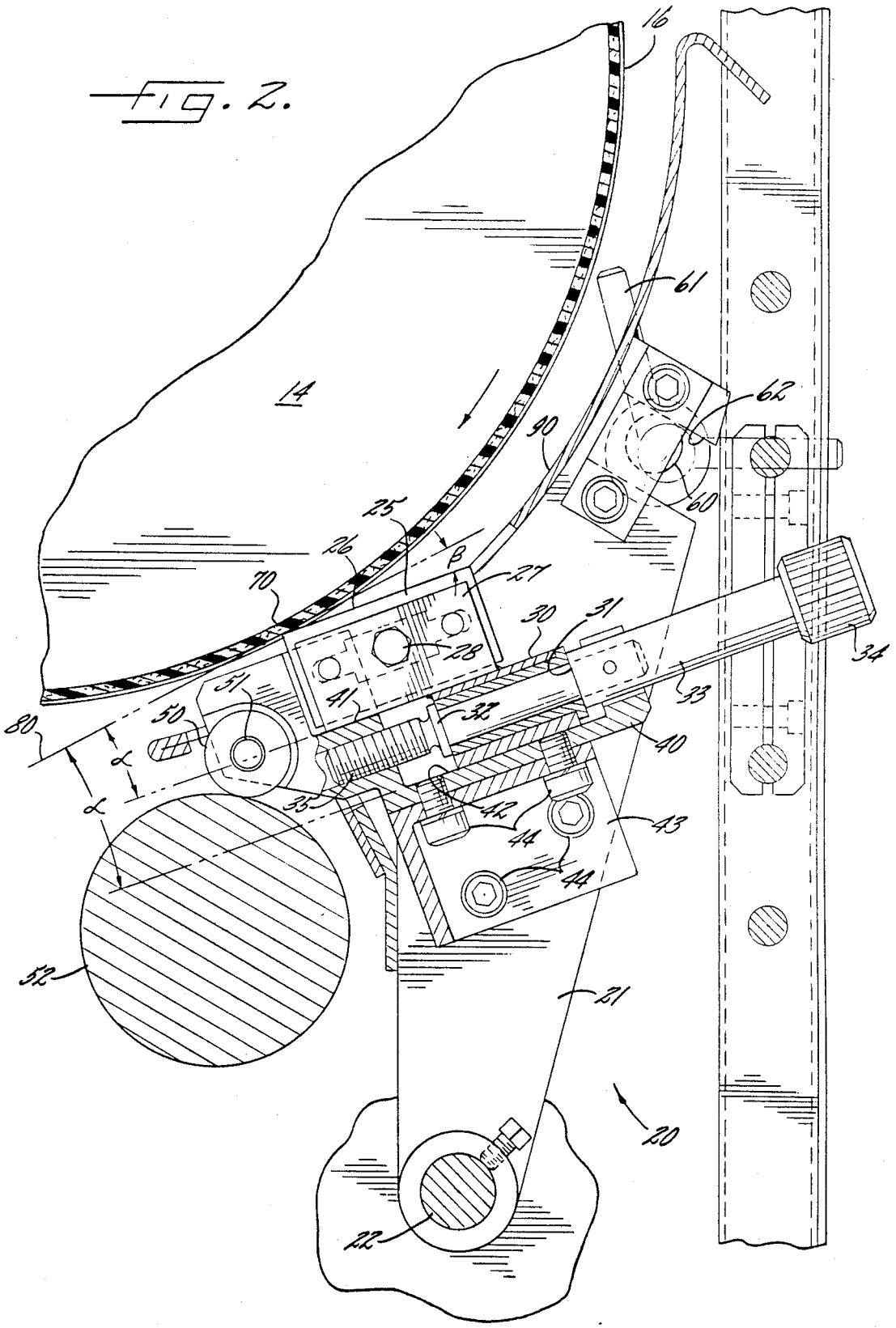
FIG. 2 is an enlarged elevational view of a cutting assembly constructed in accordance with the present invention.

FIGS. 3*a* and 3*b* show, respectfully, different types of anvils cooperating with the fixed blade.

FIG. 4 is a view similar to FIG. 3 but showing a rotating disk blade.

FIGS. 4*a* and 4*b*, respectively, show two different types of anvils usable with the disk blade in a shearing and semishearing procedure.

FIG. 5 is a diagram showing use of a rotating blade of the slitting type.

FIGS. 5*a* and 5*b* show use of the cutting blade of FIG. 5 with two specifically different anvils.

While the invention has been described in connection with certain preferred embodiments, it will be understood that it is not intended to limit the invention to the particular embodiments shown, but it is, on the contrary, intended to cover the various modifications and alternative forms of the invention included within the spirit and scope of the appended claims.

Turning attention to FIG. 1 there is shown a portion of a multi-color printing press 10 having a plate cylinder 11, a blanket cylinder 12 and impression cylinder 13. A feed drum 14 cooperating with the impression cylinder serves to feed sheets thereto, one after another, from a pick-up and transfer cylinder 15. A typical sheet, indicated at 16, is received from a feed table 17. All the cylinders are driven in unison by a press drive 18.

While omitted from the drawing for the sake of simplicity, it will be understood that the cylinders are equipped with grippers for gripping the leading edge of a sheet and with means for synchronously operating the grippers to effect transfer of the sheet from one cylinder to the next along the printing path and into engagement with a conveyor 19 which leads to a subsequent printing unit. For an understanding of the details of the grippers and gripper operators, which may be entirely conventional, reference is made to the voluminous prior art.

The cutting assembly, indicated at 20, includes an arm 21 (FIG. 2) mounted upon a cross shaft 22 which extends parallel to the shaft of the cooperating feed drum 14. The arm mounts a stationary knife blade 25 having a cutting edge 26 and which is mounted in knife blade support 27 having a clamp 28 for holding the blade in a fixed position. For the purpose of moving the support 27 endwise for adjustment of the blade, the support 27 is mounted upon a traveling block 30 which is axially captive between shoulders 31, 32 on a spindle 33 having a knurled outer end 34 for manual turning and having a threaded tip 35. The tip is threadedly engageable with a yoke 40 having way surfaces 41, 42 thereon which engage the blade support 27 and the block 30, respectively. The yoke is rigidly secured to the arm 21 by means of a platform member 43 having screws 44, 45, respectively.

For the purpose of limiting the rocking movement of the assembly about shaft 22 and for establishing a reference cutting position for the frame, the yoke 40 at its forward end carries a roller 50 rotatable on an axle 51 and having in its path of movement, and secured to the frame, a fixed cross shaft 52.

For clamping the arm 21 of the assembly in its reference cutting position, the arm includes, at its upper end, a locking or clamping device in the form of an eccentric 60 having an operating arm 61. Rocking the arm crowds the eccentric against a land surface 62, with respect to which the eccentric is bodily movable. The eccentric land surface 62 may be on the arm and the eccentric 60 may be mounted on the press frame as shown. Or, if desired, the positions of the eccentric and its land surface may be reversed, with the eccentric being mounted upon the arm 21 and the land surface 62 forming a part of the press frame.

For cooperating with the edge 26 of the blade 25 an anvil 70 is provided in the form of a ring of hard material which extends, in a groove 71, about the periphery of the feed drum. As shown in FIG. 3*a*, the blade and anvil are in edge-to-surface contact. The anvil may be formed of "hard fabric", that is, fabric which is embedded in durable plastic which may be either of the thermo setting or thermally plastic type, for example, nylon.

In accordance with the invention, way surfaces 41 and 42 between the yoke 40 elements 27, 30 are parallel to one another and so angled as to guide the knife blade for movement in a plane perpendicular to the feed drum and along a path of adjustment which bears a relatively small angle with respect to a line of tangency to the feed drum. Thus as seen in FIG. 2, the way surfaces 41, 42 both bear the same angle $\alpha$ with respect to the line of tangency 80. Such angle may be on the order of 5 to 10 degrees. At the same time the edge 26 of the blade bears a relatively small angle $\beta$ with respect to the line of tangency which is preferably within the range of 5 to 10 degrees.

Finally, for the purpose of guarding and protecting the cutting region an arcuate guard plate 90 may be provided by closely following the outer surface of the feed drum as shown in FIG. 2.

In operation, and starting with the arm 21 withdrawn rearwardly into a "clear" position, the arm is rocked counterclockwise about the pivot shaft 22 until the roller 51 seats on the surface of shaft 52 to establish the reference cutting position. With the arm 21 in reference position the eccentric 60 is rocked by its arm 61 to crowd the eccentric 60 against the land surface 62 so that the arm is locked in the cutting position. The knurled end 34 of the spindle 33 is manually rotated to advance the screw 33 into the yoke 40, moving with it the block 30 and the blade support 27 so that the edge of the blade is advanced into the desired degree of cutting engagement with the sheet. Left in position, the knife blade thereafter cuts the sheets which are received one after another and just prior to printing which occurs between the blanket and impression cylinders.

An alternative form of anvil may be used as shown in FIG. 3*b* where the anvil is in the form of hard metal rings 70*a*, 70*b*, seated in groove 71 and having a slight axial spacing between them to form a blade-receiving groove 72. Using such construction slitting of the sheet may take place without actual contact between the knife blade and the anvil.

The structure described above employs a fixed blade but it is within the scope of the invention to employ a blade of disk type having a sharpened cutting edge, as shown in FIGS. 4 and 5. Referring to FIG. 4, the blade, indicated at 25*a*, is bevelled on one side to form a sharpened edge 26*a* and has a shaft 27*a* which will be understood to be rotatably mounted, in a suitable bearing, upon the blade support 27. In the embodiment illustrated in FIG. 4*a* the anvil is in the form of a ring 70*c* of hard material which is overlapped by the sharpened edge 26*a* of the knife blade 25*a*, and in contact with it, to cut the sheet by a shearing action similar to the action which takes place between the blades of a scissors. Alternatively, the anvil may be in the form illustrated at 70*d* (FIG. 4*b*) where the anvil is recessed in a groove 73 and slightly offset, in the axial direction, from the edge of the blade. This results in a modified shearing action which may be considered a combination of that shown in FIGS. 3*b* and 4*a*, depending upon the actual spacing between the knife and the anvil.

As a further alternative, a disk type knife blade 25*b* may be provided which is symmetrically beveled on both sides to define a sharpened edge 26*d*, the blade being rotatable on an axle 27*b* as a result of cutting action. As shown in FIG. 5*a*, the blade 25*b* may run in edge-to-surface contact with an anvil 70*e* which may again be in the form of "hard fabric" recessed in the surface of the feed drum as described in connection with FIG. 3*a*. If desired, the anvil may be formed of a strip of steel or other hard metal as illustrated at 70*f* in FIG. 5*b*. In either case cutting takes place by slitting action rather than by shearing, or modified shearing, which occurs when the blade and its anvil are overlapped with one another.

It will be understood that by making the arm 21 slidable axially along the pivot shaft 22, and adjustably fixing it thereto, a cut may be made at any point along the width dimension of a passing sheet.

While the invention has been discussed in connection with the making of a single cut in the sheet, one skilled in the art will, in light of the above, will understand that a plurality of cutting assemblies of the type described may be spaced side-by-side with their frames pivoted for rocking movement about a common axis for producing multiple cuts simultaneously in the sheet.

It will be seen that the construction which has just been described amply fulfills the objects set forth above. The device is simple and economical and easily operated, the arm 21 being manually swung into position where it is clamped by eccentric 60, following which the knurled end 32 of the spindle may be rotated to advance the knife blade to the desired degree. Preferably, the spindle may be calibrated in the same fashion as the spindle caliper without departing from the invention and particularly to insure against adjusting the blade for too deep a cut. It is one of the features of the construction that, by loosening the eccentric 60, the arm 21 may be disengaged or "thrown off" for inspection of the cutting region or when cutting is no longer desired. When the arm 21 is restored to its normal cutting position, with roller 50 in contact with shaft 52 following throw-off, the original adjustment is automatically reproduced without care or attention on the part of the operator. By having a sharp blade, either stationary or rotatable, in running edge-to-surface engagement with the anvil the passing sheet is efficiently slit, but it is also possible to adjust the blade, as noted, so that it is in slight overlapping engagement of the anvil in which case the sheet is cut by a shearing or modified shearing action. Whether slitting or shearing is primarily desired, is dependent upon the type composition of the sheet being cut; whichever works best with the particular sheet being used is the one chosen.

We claim:

1. In a sheet fed printing machine having a plate cylinder, blanket cylinder and impression cylinder as well as means including a feed drum for supporting individual sheets and feeding them one after another to the impression cylinder for printing by the blanket cylinder, a cutting assembly comprising, in combination, a knife blade having a cutting edge, a knife blade support, an arm for mounting said support adjacent the feed drum, the arm being pivoted about an axis parallel to the axis of the feed drum for limited rocking movement toward and away from the feed drum, means including a stop and a clamp for establishing a reference cutting position for the arm said stop acting as an abutment to define said reference position and said clamp serving as a means for locking said arm in said reference position, the feed drum having an anvil extending around its periphery cooperating with the edge of the knife blade for cutting of the sheet, way surfaces between the knife blade support and the amr for guiding the knife blade support for linear movement in the plane perpendicular to the axis of the feed drum and along the path of adjustment which bears an angle of between about 5° to 10° to a line tangent ot the feed drum at the point of cutting when said arm is in said reference cutting position, and means including a manually operated adjusting screw effectively interposed between the arm and the knife blade support for adjusting the knife blade support along its path of adjustment on said way surfaces thereby to vary the degree of engagement of the knife blade with respect to the anvil surface.

2. The combination as claimed in claim 1 in which the knife blade is substantially straight and stationary relative to the knife blade support, with the straight edge thereof making an angle of between about 5° to 10° to a line tangent with the sheet at the point of cutting.

3. The combination as claimed in claim 1 in which the anvil is in the form of a pair of hardened rings supporting the sheet and which are axially separted by a narrow groove with the edge of the knife blade extending a short distance into the groove so that the sheet is cut with a modified shearing action.

4. The combination as claimed in claim 1 in which the knife blade is in the form of a disk having flat side and a beveled side and rotatably mounted in the knife blade support and in which the anvil is in the form of a hardened ring which overlaps the flat side the knife blade so that the sheet is cut with a shearing action as the cylinders rotate.

5. The combination as claimed in claim 1 in which the knife blade is in the form of a disk rotatably mounted in the knife blade support and in which the anvil is in the form of hardened ring supporting the sheet in the path of adjusting movement of the edge of the knife blade so that the sheet is cut with a slitting action as the cylinders rotate.

* * * * *